United States Patent [19]

Gelhaus

[11] 4,434,897

[45] Mar. 6, 1984

[54] CLOTHES DRYING RACK

[76] Inventor: Ralph B. Gelhaus, 4293 Minster-Ft. Recovery Rd., St. Henry, Ohio 45883

[21] Appl. No.: 322,735

[22] Filed: Nov. 19, 1981

[51] Int. Cl.[3] ..... A47B 53/00

[52] U.S. Cl. ..... 211/1.3; 211/33

[58] Field of Search ..... 211/1.3, 33, 35, 40, 211/47, 48; 312/277

[56] References Cited

U.S. PATENT DOCUMENTS

| | | | |
|---|---|---|---|
| 777,185 | 12/1904 | Coyner | 211/1.3 |
| 1,034,189 | 7/1912 | Bowman | 108/33 |
| 1,444,808 | 2/1923 | Stanley | 108/33 |
| 1,724,218 | 8/1929 | Nixon | 211/1.3 |
| 2,061,499 | 11/1936 | Bode | 211/1.3 |
| 2,434,891 | 1/1948 | Swanson | 211/1.3 X |
| 2,885,086 | 5/1959 | Lawrence | 211/1.3 |
| 3,627,142 | 7/1971 | Steiner . | |
| 3,801,174 | 4/1974 | Kanarr | 211/1.3 X |

*Primary Examiner*—William E. Lyddane
*Assistant Examiner*—Peter A. Aschenbrenner
*Attorney, Agent, or Firm*—Marmaduke A. Hobbs

[57] ABSTRACT

A clothes drying rack having a vertically elongated cabinet with a rack set disposed in the upper end thereof moveable from a vertical position in the cabinet to a horizontal position extending therefrom. The rack set is disposed in the upper end of said cabinet and is supported by the door when the rack set is moved to its horizontal position and the door is closed thereunder. The rack set includes a plurality of arms pivoted to a fixture and moveable angularly with respect to one another. The drying rack may also include a second rack set disposed in the bottom of the cabinet and moveable from a vertical position to a horizontal position beneath the door when it is closed. The lower rack has a fixture pivoted in the cabinet and a plurality of arms pivotally attached to and extending from the fixture, the arms being adapted to pivot angularly with respect to one another. A shelf may be provided on the top of the door to enhance the appearance of the rack as well as assist in supporting the arms and fixture of the upper rack set.

6 Claims, 6 Drawing Figures

Fig. 1
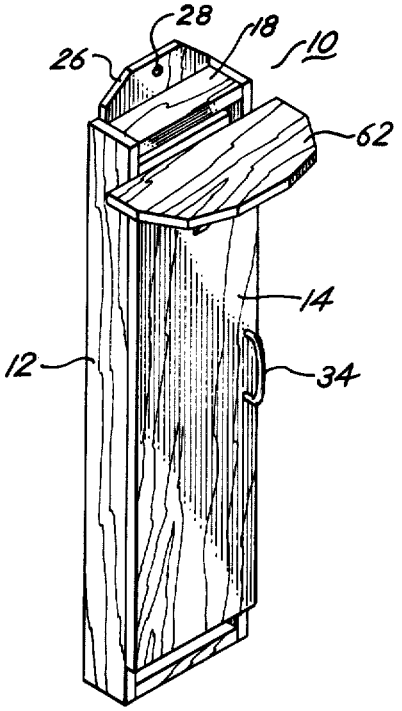
Fig. 2
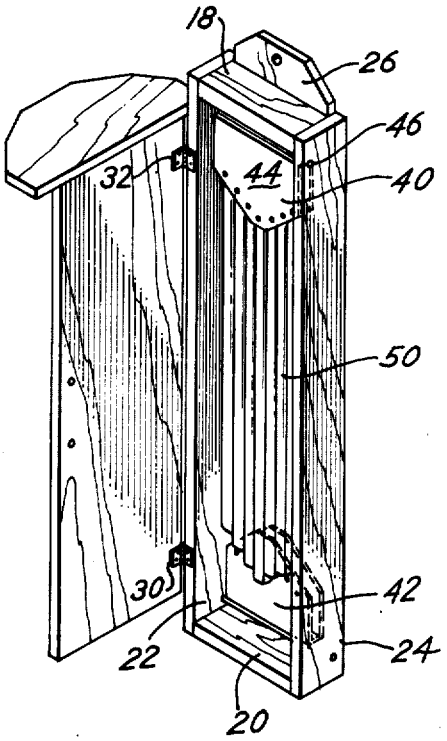
Fig. 3
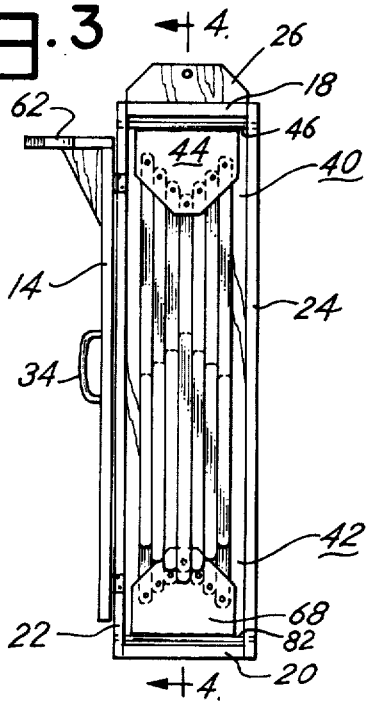
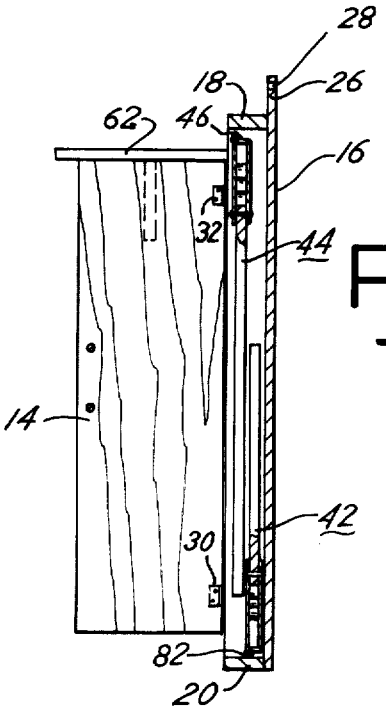
Fig. 4

CLOTHES DRYING RACK

BACKGROUND OF THE INVENTION

Over the years there have been a number of different types of clothes drying racks which consist essentially of several bars or arms supported by a frame and the clothes are hung on the arms individually to permit circulation of room air through and around the clothes to evaporate the moisture in the clothes until they become thoroughly dry. One well known and extensively used type of clothes drying rack consists of a relatively small frame mounted on a wall or other vertical supporting structure and having a plurality of arms pivoted to the frame so that they can be spread apart in a fan-like arrangement for receiving the clothes to be dried. These racks were usually so constructed that when the racks were not in use, the arms and the frame supporting the arms could be tilted downwardly so that the arms would be in a closely spaced arrangement in a vertical position near the wall or other rack supporting structure. Thus the rack was out of the way when it was not in use and yet could be quickly unfolded with the arms projecting horizontally outwardly for receiving the clothes to be dried. In this type, the frame usually consisted of a vertically positioned plate or panel which seated against the wall, and a hinged plate or panel which pivoted between a downwardly extending vertical position and an outwardly extending horizontal position and on which the arms were pivotally mounted for swinging therewith. While this type of rack is convenient to use and is easily folded and unfolded, it is rather conspicuous and sometimes unsightly. It is therefore one of the principal objects of the present invention to provide a clothes drying rack of the foldable fan-type briefly described hereinbefore, in which a cabinet is constructed integrally with the arms and supporting plate so that the rack is fully concealed when it is not in use, and which can easily be unfolded and extended for drying clothes, and readily folded into and enclosed in the cabinet.

Another object of the invention is to provide a clothes drying rack of the aforesaid type which has a cabinet enclosing the rack when it is not in use and a door which supports the arms of the rack when they are extended for drying clothes, and which presents a pleasing and neat appearance when it is in its folded position and the door is in closed position.

Still another object of the invention is to provide a clothes drying rack of the foldable fan-type in which sets of foldable arms are disposed at the top and bottom of a cabinet, are foldable into the cabinet when not in use, and can be used at the same time or selectively as desired, and which is compact and simple to fold and unfold when located in a variety of different places.

Other object and advantages of the invention will become apparent from the following description with reference to the accompanying drawings.

SUMMARY OF THE INVENTION

The invention relates to a clothes drying rack having a cabinet with a door hinged at one side, and a plurality of clothes hanging arms pivotally supported by a panel in the top of the cabinet and arranged to move from a folded vertical position in the cabinet to an unfolded position with the arms extending horizontally from the top of the cabinet. The panel is hinged or otherwise pivotally mounted in the cabinet and is held in a horizontal position when the arms are unfolded by the top of the cabinet door. When the panel and arms are in a horizontal position, the inner ends of the arms are pivoted to permit the arms to open and close in a fan-like manner. A plate mounted on the upper edge of the door may be used to give additional support to the arms when they are disposed in the horizontal position. A second set of arms pivotally mounted on a hinged panel may be disposed in the bottom of the cabinet, arranged to unfold downwardly from a vertical position to a horizontal position where the arms can be opened and closed in a fan-like manner. The upper and lower sets of arms fold downwardly and upwardly, respectively, into the cabinet in such a manner that the cabinet door may be fully closed and the arms fully concealed.

BRIEF DESCRIPTION OF THE DRAWINGS

FIG. 1 is a perspective view of a clothes drying rack embodying the present invention, showing the rack arms enclosed in a cabinet forming a part of the rack;

FIG. 2 is a perspective view of the clothes drying rack shown in FIG. 1 illustrating the cabinet with the door thereof in open position;

FIG. 3 is a front elevational view of the cabinet shown in FIGS. 1 and 2 with the door in open position and the rack in folded position;

FIG. 4 is a vertical cross sectional view of the rack shown in FIG. 3, taken on line 4—4 of FIG. 3, with the door of the cabinet in open position;

DESCRIPTION OF THE PREFERRED EMBODIMENT

Figure 5:
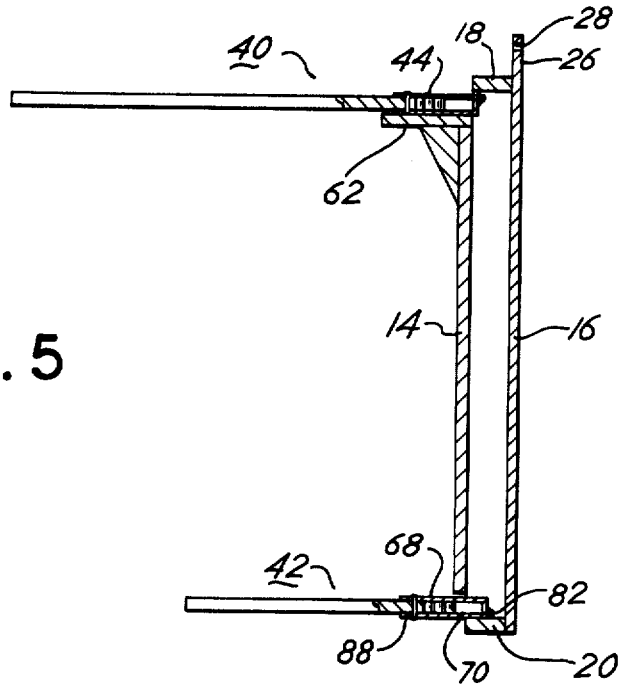
FIG. 5 is a vertical cross sectional view of the rack shown in its unfolded and fully extended position.

Referring more specifically to the drawings, numeral 10 indicates generally the present clothes drying rack with the door in closed position. The rack may be of various sizes and may be constructed of various materials, although wood or plastic would be the material normally used in the construction of the rack.

In FIG. 1, the cabinet 12, shown with the door 14 thereof in closed position, consists of a rear panel 16, top panel 18, bottom panel 20 and two side panels 22 and 24. The two side and top and bottom panels are joined rigidly together, and the back is secured firmly thereto. The back preferably has an upwardly projecting extension 26 with a hole 28 therein for mounting the rack on a wall or other supporting structure. The door is hinged to side wall 22 by hinges 30 and 32, and a door handle 34 is preferably provided near the opposite edge to facilitate opening of the door. The door may be held closed by any suitable means, such as a magnetic or snap latch of well known construction.

As shown in the drawings the rack has an upper set of clothes hangers 40 and a lower set 42. The upper set consists of a fixture 44 pivotally mounted on a pin 46 in the upper end of cabinet 12, the fixture preferably being constructed of sheet metal, and being folded into a U-shaped configuration to provide a slot for receiving a plurality of arms 50 pivotally attached to fixture 40. The pin 46 extends through a loop or channel in the fixture and into holes in the two side walls. As an alternative, the fixture may be secured by a hinge to the top wall in the cabinet. In the embodiment illustrated, the upper set includes seven arms 53, 54, 55, 56, 57, 58 and 59. These arms are seated in the slot in fixture 44 by pins 60 extending through two sides of the fixture and through the inner ends of the respective arms. The arms thus pivot readily from a closed position as seen in FIGS. 2 and 3 to the spread position shown in FIG. 6. The set 40 pivots on pin or shaft 46 from the vertical position illustrated in FIGS. 2 and 3 to the horizontal position shown in FIGS. 5 and 6, and the set is supported in its horizontal position by plate 62 on the upper edge of door 14. The door, including plate 62, is spaced downwardly from upper end wall 18 so that the door will close after the rack set has been moved to its horizontal position, thus permitting the plate to support the rack set. The plate 62 may be omitted if desired, thereby permitting the upper edge of the door to serve as the support for the rack set when the set is in its horizontal position.

A rack set 42, similar to set 40, consists of a fixture 70 and arms 72, 73, 74, 75, 76, 77 and 78 supported in the slot of fixture 68 by pins 80 extending through two sides of fixture 68 and through the inner ends of the arms of set 42. The fixture is pivoted on a pin or shaft 82 extending through a loop or channel on the rear side of the fixture and through the lower side walls 22 and 24 of the cabinet. A hinge may be used to attach fixture 68 to the upper surface of bottom wall 20, in place of pin 82. When the rack sets 40 and 42 are in their folded positions in the cabinet, rack set 42 is disposed behind rack set 40, as can readily be seen in FIGS. 2, 3 and 4. When the rack set 42 is to be used, it is lowered from the position shown in FIGS. 2, 3 and 4 to the position shown in FIGS. 5 and 6, and the bottom 20 of the cabinet supports the fixture and the seven arms in a horizontal position. The lower edge of the door is spaced upwardly from bottom 20 a sufficient distance to permit the door to close over the arms and the fixture of rack set 42 when the rack set is disposed in its horizontal position.

Figure 6:
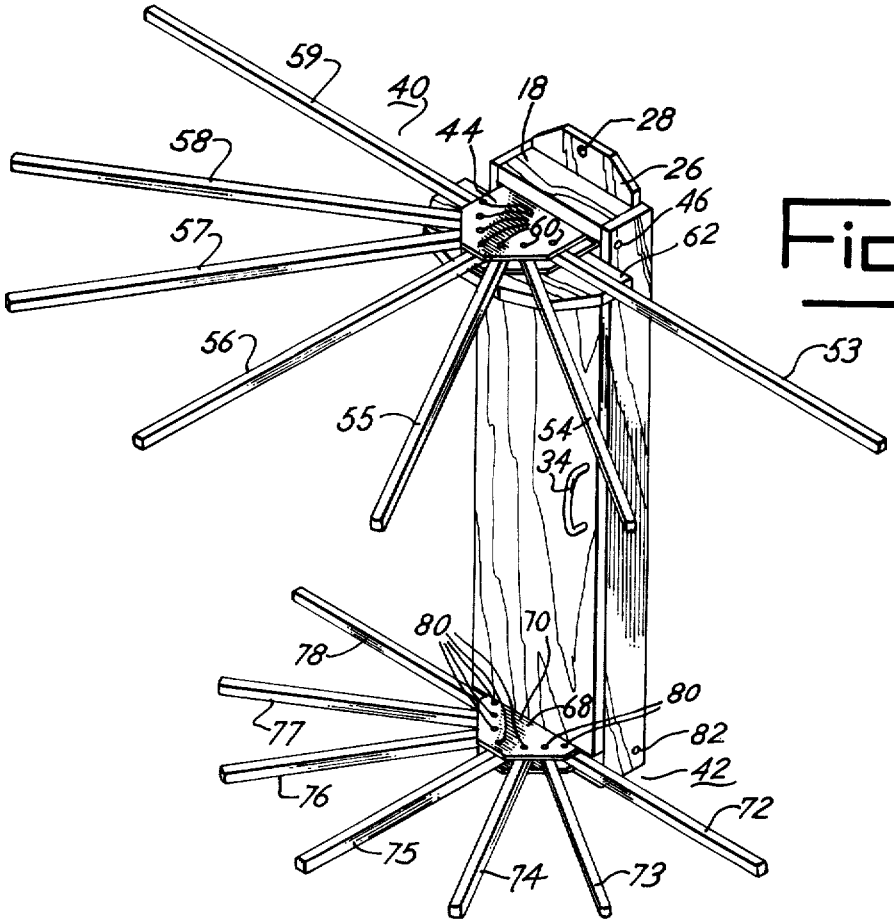
FIG. 6 is a perspective view of the rack shown in the preceding figures illustrating the rack in its fully unfolded position for supporting clothes to be dried thereon.

In the use and operation of the present clothes drying rack, the rack is mounted on a wall or other supporting structure, preferably using the hole 28 to receive a hanger such as a screw or hook. Screws may, however, be inserted through holes in the back panel from the inside of the cabinet into the supporting structure. After the rack has been mounted and is ready for use, the door is opened and rack set 40 is raised from its vertical position to its horizontal position with the arms projecting outwardly through the space between the upper edge of the door and top wall 18. If only one set is to be used, the door is then closed and plate 62 on the top of the door supports the arms and fixture 44 in their horizontal position, as seen in FIGS. 5 and 6. If the lower set is not used it can remain in its folded vertical position in the cabinet.

If the lower rack set 42 is to be used, either with or without the upper rack set, it is moved from the folded vertical position shown in FIGS. 2, 3 and 4 to the unfolded position of FIGS. 5 and 6, and, if the upper rack set is not to be used, it is returned to its vertical position after removal of the lower rack set from its vertical position to its horizontal position. The door is then preferably closed, although the lower rack set will support the clothes without the assistance of the door as a support. If both rack sets are to be used, the lower rack set is folded downwardly to its horizontal position as shown in FIGS. 5 and 6 and the upper rack set is then raised fully to its horizontal position and the door closed under the fixture 44. With the door closed, the upper rack set is supported firmly by the door and is capable of receiving a full load of clothes to be dried. The arms of each of the two rack sets can be pivoted angularly to various positions relative to one another, and can be pushed partly to one side if the space available for the rack on one side is limited. When the clothes drying rack is no longer needed, it is normally placed in its folded condition by opening the door and folding the lower rack set 42 upwardly and inwardly into vertical position in the cabinet, and the upper rack set downwardly and inwardly into vertical position in front of the folded lower rack set in the cabinet. The door is then closed and the dryer is then in the condition illustrated in FIG. 1.

In variations of the present clothes drying rack, one or the other rack sets 40 or 42 may be omitted, normally the lower rack set being eliminated and, as mentioned, a rack of more economical and compact construction may be made by omitting the plate 62. Various other changes in the present clothes drying rack may be made without departing from the scope of the invention.

I claim:

1. A clothes drying rack comprising two vertical side walls and top and bottom walls forming a cabinet, a door pivoted to one of said side walls and being spaced downwardly from said top wall and upwardly from said bottom wall, an upper rack set disposed in said cabinet in the upper part thereof and having a fixture pivoted between said side walls adjacent the upper edge of said door, said rack set having a plurality of clothes hanging arms extending radially outwardly from said fixture and pivoted at their inner ends to said fixture for moving angularly outwardly and inwardly with respect to one another, pivot means for pivoting said fixture and said arms from a vertical position in said cabinet to a horizontal position projecting outwardly from said cabinet with said rack set being supported by said door when said door is closed after said arms are lifted to horizontal position, a lower rack set disposed in said cabinet in the lower part thereof and having a fixture pivoted between said side walls, said lower rack set having a plurality of clothes hanging arms extending radially outwardly from said fixture and pivoted at their inner ends to said fixture for moving angularly outwardly and inwardly with respect to one another, and a pivot means for pivoting said fixture and said arms of said lower rack set from a vertical position in said cabinet to a horizontal position projecting outwardly from said cabinet with the lower side of said lower rack fixture being on substantially the same plane as the upper surface of said bottom wall when said lower rack set is in horizontal position, said pivot means of said lower rack set being spaced inwardly further from said door than said pivot means of said upper rack set so that said lower rack set is disposed behind said upper rack set when said rack sets are folded into said cabinet.

2. A clothes drying rack as defined in claim 1 in which a plate is secured to the upper edge of said door and forms a part thereof, and said upper rack set rests on said plate when said fixture and arms are in their horizontal position.

3. A clothes drying rack as defined in claim 1 in which the upper edge of said door and the bottom surface of said upper rack set fixture are substantially on the same plane when said fixture and arms supported thereby are in their horizontal position.

4. A clothes drying rack as defined in claim 1 in which hinge means secures said door to the forward edge of one of said side walls, and said door swings from a closed position to a wide open position where said arms can pass from a vertical position in said cabinet to a horizontal position extending from said cabinet without interference from said door and said door can thereafter be moved to closed position while said rack sets are in horizontal position.

5. A clothes drying rack as defined in claim 1 in which each of said pivot means consists of a pin extending from one side wall to the other and channels are provided for pivotally securing said fixture to said pin.

6. A clothes drying rack as defined in claim 1 in which the cabinet is vertically elongated and a means is provided for securing said drying rack to a wall or other supporting surface.

* * * * *